US006595517B1

(12) United States Patent
Tranquilla

(10) Patent No.: US 6,595,517 B1
(45) Date of Patent: Jul. 22, 2003

(54) DOCUMENT TRANSPORT FOR ACCURATE PRINTING

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/924,261

(22) Filed: Aug. 7, 2001

(51) Int. Cl.[7] ..... B65H 5/04
(52) U.S. Cl. ..... 271/275
(58) Field of Search ..... 271/275

(56) References Cited

U.S. PATENT DOCUMENTS 3,941,375 A * 3/1976 La White et al. ..... 271/251
4,659,073 A * 4/1987 Leonard ..... 271/3.14
5,676,368 A * 10/1997 Wilson et al. ..... 271/225
5,848,784 A * 12/1998 Tranquilla ..... 271/10.03

* cited by examiner

*Primary Examiner*—Donald P. Walsh
*Assistant Examiner*—Kenneth W Bower
(74) *Attorney, Agent, or Firm*—Lise A. Rode; Mark T. Starr; Harness, Dickey & Pierce

(57) ABSTRACT

A document transport for moving documents past a document processing station utilizes a drive roller having a mass sufficient to provide a flywheel effect to stabilize speed of documents passing between the drive roller and a pinch belt in contact with a portion of the circumference of the drive wheel. The drive wheel may additionally have a circumference large enough to prevent document slippage between the drive wheel and the pinch belt.

14 Claims, 4 Drawing Sheets

DOCUMENT TRANSPORT FOR ACCURATE PRINTING

FIELD OF THE INVENTION

The present invention relates to document processing equipment, and more particularly to a document transport apparatus at a document processing station for providing accurate processing.

BACKGROUND OF THE INVENTION

Printing on documents using non-fully-formed devices requires accurate knowledge of the motion of the document in order to place dots or spray lines on the document with sufficient accuracy for machine reading. Typically, motors and synchronous belts are used to impart motion to document drive rollers. These motors and belts have cogging forces which can sometimes cause short term speed fluctuations. Because characters or symbols to be printed are typically small (about ⅛ inch or smaller), such short term speed fluctuations can cause inaccurate character placement. This inaccurate placement of the ink on the document makes the character or symbol impossible to machine read.

Printer accuracy can be improved by reducing the cogging forces of the drive rollers. Conventional systems attempt to reduce the cogging forces by providing extremely high precision motors and motion transmission devices which are expensive. Other systems use flywheels to minimize short term speed fluctuations caused by cogging or other pulsing type forces.

In addition, many other types of document transports allow approximately 0.1 inch of document movement perpendicular to the transport direction. As such, conventional document transport systems used in conjunction with non-fully-formed character printers may allow the document to slip with respect to drive rollers because they do not enable a firm grip. Speed regulation is inadequate unless extra flywheels are added, which add to the space issues, cost issues and complexity of the document transport.

In general, a flywheel is a device for storing energy or momentum in a rotating mass. Flywheels are usually a heavy wheel which may be any shape, such as disk or saucer, and are typically symmetric. Flywheels are used for a variety of purposes. One commonly known mechanical purpose of flywheels is to moderate speed variations in an engine. The flywheel uses its inertia to even out quick power outbursts by a power supply or sudden loads on a system.

SUMMARY OF THE INVENTION

As such, it is desirable to provide a document transport for providing speed regulation for documents that are to have characters or other machine readable symbols printed on them by non-fully-formed character or symbol printing devices, such as ink-jet printers, or thermal or impact dot matrix printers, and the like.

The present invention provides document drive rollers that are of relatively large moment of inertia to minimize speed fluctuations and are simultaneously arranged so as to enable a firm grip of the document while being printed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

It will be understood that the invention may be adapted for use with check reader/sorter/amount encoder/sorters, batch ticket printers, check amount encoders, check printers, security document printers, deposit envelope, deposit slip printers for ATMs and the like.

Figure 1:
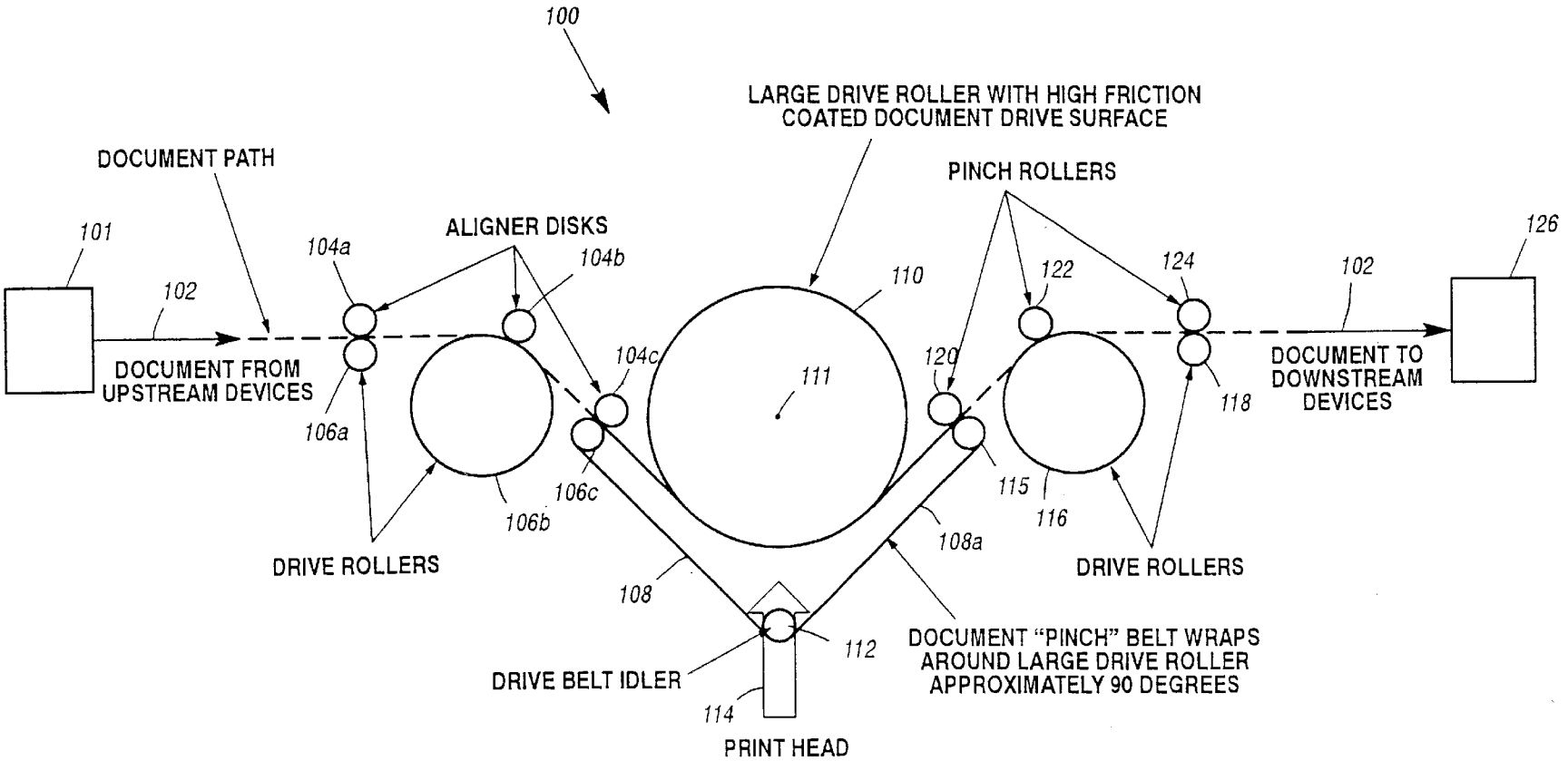
FIG. 1 is a plan view of a preferred embodiment of a document transport apparatus taken from above a base plate and arranged according to the principles of the present invention.
Figure 1A:
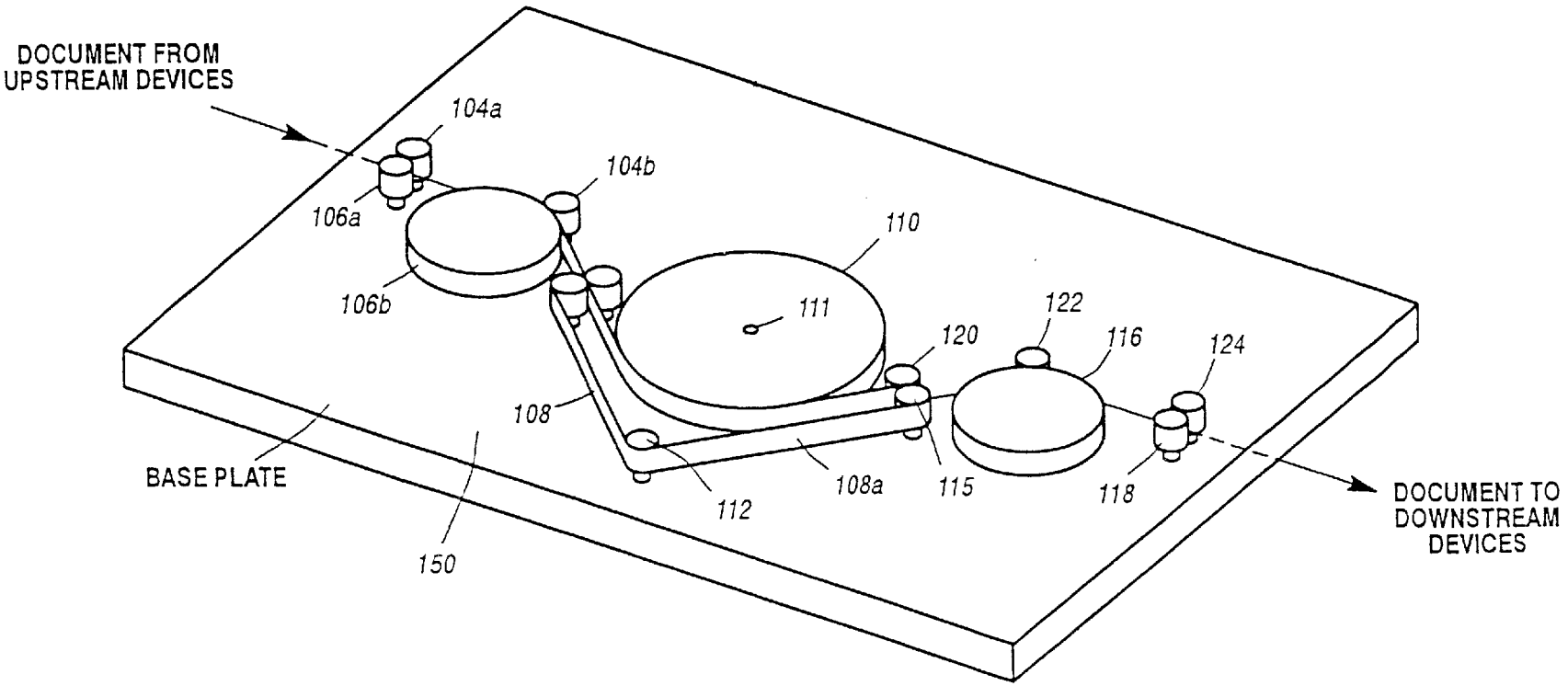
FIG. 1A is a perspective view of the embodiment of FIG. 1.

FIGS. 1 and 1A illustrates a document transport 100 having a primary document transport apparatus arranged according to the principles of the present invention. The document transport apparatus includes components that are commonly placed above or on one side of a plane known as a baseplate 150 (FIG. 1A). The document drive components typically have shafts rigidly connected to them which protrude through and below the baseplate 150. These shafts are allowed to rotate in bearing systems typically mounted to the baseplate. At the bottom end of these shafts, pulleys, belts and/or motors are connected to provide rotational motion to the document drive components. The document drive components are most commonly employed with document drive rollers. For clarity the "below baseplate" components are not shown, but these components are well known to those practiced in the arts of transporting documents. FIG. 1 presents apparatus of a preferred embodiment as seen from a view taken normal to baseplate 150 of FIG. 1A.

Documents, such as 102 of FIG. 1, may enter the document transport from a variety of upstream devices 101, such as document feeders, other transports that endorse checks, etc. They may be inadequately aligned to accurately print at precise locations on the document with respect to a registration edge. For this reason, aligner disks, such as 104*a, b, c*, may be used for the pinch rollers for the first few drive rollers 106*a, b, c* in the document transport. Such aligning disks are well known to those practiced in the arts of transporting documents.

After alignment, the documents 102 enter the pinch or grip between the large drive roller 106*b* and the pinch belt 108. The pinch belt 108 wraps around a substantial portion of the circumference of the large diameter roller 110. The pinch belt 108 is driven by the large diameter roller 110. This belt 108 in turn drives the document 102 just before and just after the large diameter drive roller 110. Belt 108 also drives an idler 112 which enables the bolt 108 to be of continuous construction. This idler 112 is spring loaded to provide tension in the belt. The belt tension provides substantial pinch force between the belt 108 and the large diameter drive roller 110.

Drive roller 110 is large enough so that length of grip between the tangent point of the belt/large roller and the print head 114 is a substantial portion of the length of the documents being processed to provide a substantial grip of the document just before printing commences and throughout printing on the beginning portion of the document, thereby preventing document slippage between the large drive roller 110 and the pinch belt 108. Drive roller 110 is additionally made large enough to provide requisite mass for flywheel effect (in a check processing application, on the order of 10 inches in diameter) to stabilize documents, such as checks, at reading stations.

Similarly, after printing stops, possibly near the end of the document, there is an equally large length of grip between the print head 114 and the tangent point of the belt/large roller to provide a substantial grip of the document throughout document processing, such as printing, on the remaining portion of the document, thereby preventing document slippage between the large drive roller 110 and the pinch belt 108. Additionally, the surface of drive wheel 110 preferably utilizes a friction material which provides further document slippage prevention.

Document 102 is initially discharged from the processing station by the right-hand portion 108*a* of pinch belt 108 in conjunction with pinch roller 120 and idler 115.

After exiting the pinch belt 108, the document 102 is under control of the last two drive rollers 116 and 118. These drive rollers 116 and 118 have associated therewith typical pinch rollers 122 and 124, which are well known to those practiced in the art of transporting documents. The document 102 is delivered to a downstream device 126, such as microfilms, digital imagers, stackers, etc.

Figure 2:
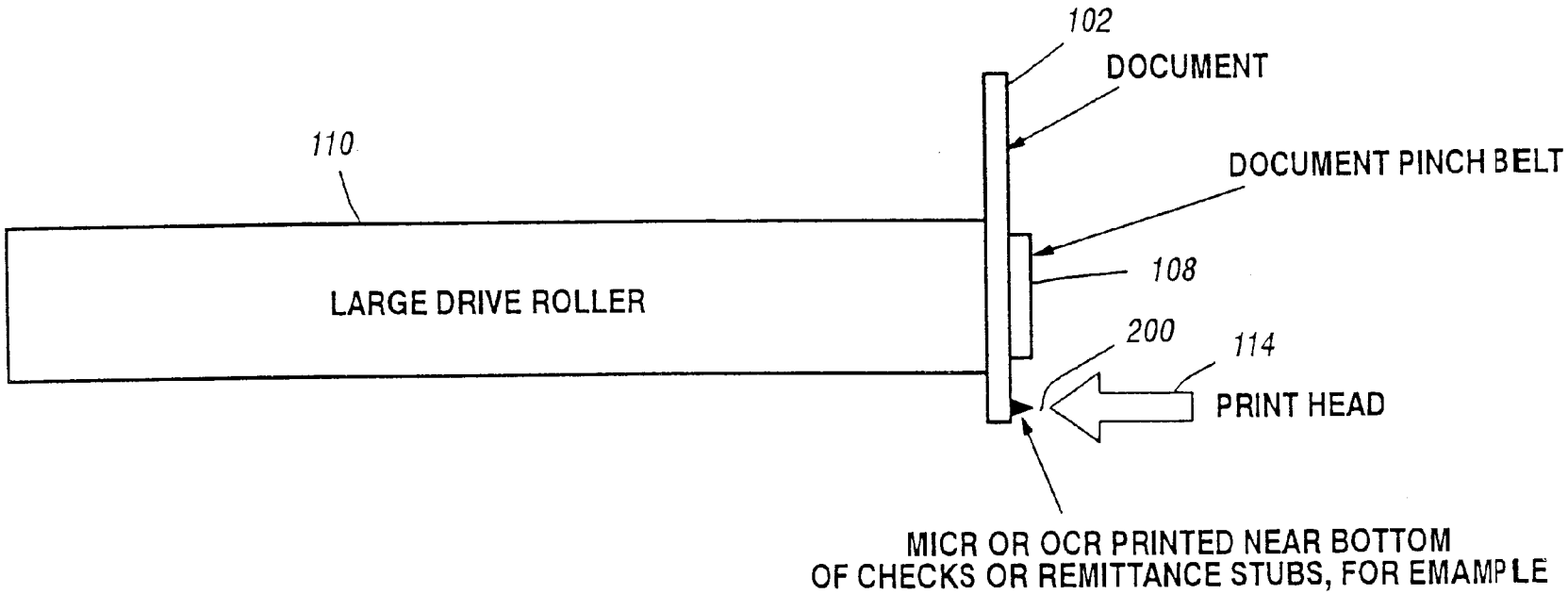
FIG. 2 is a cross-sectional side view of a preferred embodiment of the document transport apparatus of FIG. 1.

FIG. 2 is a view of a section in FIG. 1 passing through the large drive roller center axis of rotation 111 and the print head 114. Some types of print heads, such as certain inkjet print heads, may require space behind the document for sensors. These sensors detect jets of ink for adequacy when the document is not present. FIG. 2 illustrates space 200 behind the document 102 if such sensors are necessary.

Figure 3:
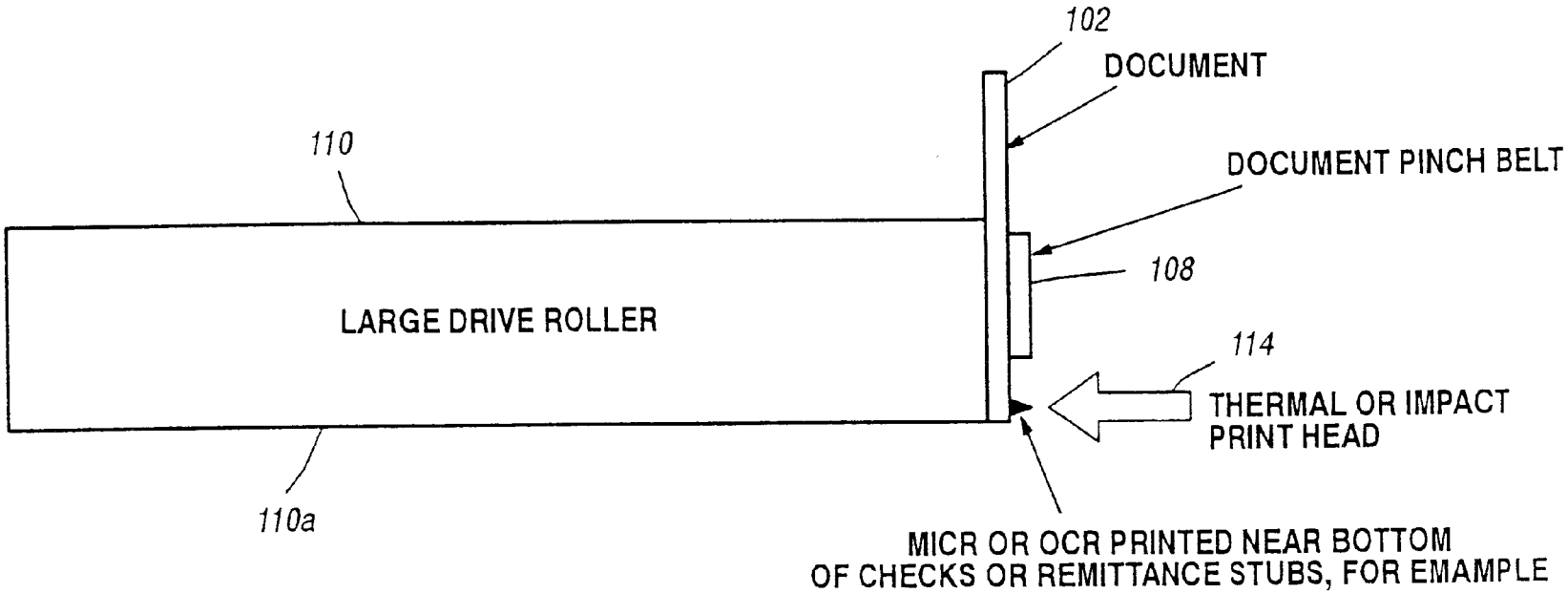
FIG. 3 is a cross-sectional side view of another preferred embodiment of the document transport apparatus of FIG. 1.

FIG. 3 illustrates a modification to the large diameter roller 110 to accommodate printing processes that require substantial force be applied to the document, such as for dot matrix impact printer applications, for example. The bottom edge 110*a* of the large drive roller is lowered to provide a massive and rigid back-up of the document opposite the print head.

Also, because the pinch belt 108 wraps the document 102 around the curvature of the large drive roller 110, the document 102 is stiffened in the direction of the print head 114. Other types of document transports allow approximately 0.1 inch of document movement perpendicular to the transport direction. In this invention, the wrap and the stiffening eliminate this perpendicular movement, providing a more consistently precise distance between the document and print head. This results in more accurate printing.

The symmetrical arrangement of all the drive rollers 106*a*, 106*b*, 116, 118 and pinch belt 108 serves to provide the property that a document leave the transport in the same direction and at the same elevation as it entered the transport. This enables the transport to be inserted in existing document processing equipment without major modification to the existing equipment.

The large diameter drive roller 110 further provides an efficient way to obtain a large moment of inertia. A large moment of inertia provides a flywheel effect, which makes the document move smoothly and with good speed regulation through the printing area. It is commonly known from principles of engineering mechanics that the moment of inertia is proportional to the fourth power of the flywheel diameter for an homogeneous cylinder and proportional to the first power of the flywheel cylinder's material density. Therefore, it is more efficient to use a large diameter as well as a high material density for the drive roller 110.

Gripping the document against the large moment of inertia, large drive roller gives the best short term speed regulation to the document.

Additionally, the drive rollers 106*a*, 106*b*, 116, 118 on either side of the large drive roller 110 that have a somewhat smaller diameter, further serve to provide flywheel effect to the entire document transport, enhancing speed regulation. Additionally, they provide a smooth turning of the document towards and away from the large diameter drive roller.

The present invention preferably uses friction material as a drive roller surface plus increased surface to surface contact between drive roller and the document to minimize slippage.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A document transport for moving documents past a document processing station, the document transport including:

a drive roller adapted to be positioned adjacent the document processing station;

a pinch belt wrapped around a portion of the circumference of the drive roller and driven by the drive roller; and, a drive belt idler for providing tension to the pinch belt, and adapted to be positioned adjacent the portion of the circumference of the drive roller around which the pinch belt is wrapped, wherein the drive roller has a mass sufficient to provide a flywheel effect to stabilize speed of documents passing between the drive roller and the pinch belt.

2. The document transport of claim 1 wherein the drive roller has a circumference large enough to prevent document slippage between the drive roller and the pinch belt.

3. The document transport of claim 1 wherein the portion of the circumference of the drive roller is on the order of 90°.

4. The document transport of claim 1 wherein a diameter of the drive roller is on the order of at least 10 inches.

5. The document transport of claim 1 further including:

at least one input drive roller having an axis of rotation positioned at a first side of an axis of rotation of the drive roller and adapted for feeding documents between the pinch belt and the drive roller; and at least one output drive roller having an axis of rotation positioned at a second side of the axis of rotation of the drive roller and adapted for withdrawing documents from between the pinch belt and the drive roller.

6. The document transport of claim 5 wherein the input and output drive rollers are symmetrically positioned at directly opposite sides of the axis of rotation of the drive roller.

7. A document transport for moving documents past a document processing station, the document transport including:

a first drive roller adapted to be positioned adjacent the document processing station;

a pinch belt wrapped around a portion of a circumference of the fist drive roller and driven by the drive roller, and, a drive belt idler for providing tension to the pinch belt, and adapted to be positioned substantially adjacent the midpoint of the portion of the circumference of the first drive roller around which the pinch belt is wrapped, wherein the first drive roller has a circumference large enough to prevent document slippage between the first drive roller and the pinch belt.

8. The document transport of claim 7 wherein the portion of the circumference of the first drive roller is on the order of 90°.

9. The document transport of claim 7 wherein a diameter of the first drive roller is on the order of at least 10 inches.

10. The document transport of claim 7 further including:

at least one input drive roller having an axis of rotation positioned at a first side of an axis of rotation of the first drive roller and adapted for feeding documents between the pinch belt and the first drive roller; and at least one output drive roller having an axis of rotation positioned at a second side of the axis of rotation of the drive roller and adapted for withdrawing documents from between the pinch belt and the drive roller.

11. The document transport of claim 10 wherein the at least one input drive roller and the at least one output drive roller are symmetrically positioned at opposite sides of the axis of rotation of the first drive roller.

12. A document transport for moving documents on an edge thereof past a document processing station along a path defined by a surface of a baseplate, the document transport comprising;

a primary drive roller mounted to the baseplate surface for rotation of a drive roller contact spice about an axis of rotation substantially normal to the baseplate surface, the contact surface positioned for presenting documents abutting the contact surface to a document processor, a pinch belt having a pinch belt contact surface in contact with a portion of the drive roller contact surface and adapted for applying pressure to documents passing along the drive belt contact surface facing the document processor, and, a spring-loaded drive belt idler for providing tension in the pinch belt the spring-loaded drive belt idler being mounted to the baseplate positioned substantially adjacent to a midpoint of the pinch belt contact surface, wherein the primary drive roller has a mass sufficient to provide a flywheel effect to stabilize speed of documents passing between the primary drive roller and the pinch belt.

13. The document transport of claim 12 further comprising:

at least two input drive rollers mounted to the baseplate surface at a first side of the primary drive roller for presenting documents thereto; and at least two output drive rollers mounted to the baseplate surface at a second side of the primary drive roller for extracting documents therefrom.

14. The document transport of claim 13 wherein the input drive rollers and the output drive rollers are mounted to the base plate surface symmetrically with respect to the primary drive roller.

* * * * *